US009620847B2

(12) United States Patent
Kamgaing

(10) Patent No.: US 9,620,847 B2
(45) Date of Patent: Apr. 11, 2017

(54) INTEGRATION OF MILLIMETER WAVE ANTENNAS ON MICROELECTRONIC SUBSTRATES

(75) Inventor: Telesphor Kamgaing, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 326 days.

(21) Appl. No.: 13/996,827

(22) PCT Filed: Mar. 26, 2012

(86) PCT No.: PCT/US2012/030634

§ 371 (c)(1),
(2), (4) Date: Mar. 19, 2014

(87) PCT Pub. No.: WO2013/147744

PCT Pub. Date: Oct. 3, 2013

(65) Prior Publication Data

US 2014/0191905 A1 Jul. 10, 2014

(51) Int. Cl.
*H01Q 1/22* (2006.01)
*H01Q 21/00* (2006.01)

(52) U.S. Cl.
CPC ..... *H01Q 1/2283* (2013.01); *H01Q 21/0025* (2013.01); *Y10T 29/49016* (2015.01)

(58) Field of Classification Search
None
See application file for complete search history.

(56) References Cited

U.S. PATENT DOCUMENTS

2004/0189528 A1* 9/2004 Killen ..... H01Q 9/0457 343/700 MS
2006/0081982 A1 4/2006 Huang et al.
2007/0146206 A1 6/2007 Sun
2010/0033395 A1* 2/2010 Ding ..... H01Q 1/2283 343/834
2011/0140971 A1 6/2011 Schwanke et al.

FOREIGN PATENT DOCUMENTS

WO 2013/147744 A1 10/2013

OTHER PUBLICATIONS

International Preliminary Report on Patentability and Written Opinion received for PCT Patent Application No. PCT/US2012/030634, mailed on Oct. 9, 2014, 8 pages.
International Search Report and Written Opinion Received for PCT Patent Application No. PCT/US2012/030634, Mailed on Nov. 14, 2012, 12 pages.

* cited by examiner

*Primary Examiner* — Robert Karacsony
(74) *Attorney, Agent, or Firm* — Winkle, PLLC

(57) ABSTRACT

A high performance antenna incorporated on a microelectronic substrate by forming low-loss dielectric material structures in the microelectronic substrates and forming the antenna on the low-loss dielectric material structures. The low-loss dielectric material structures may be fabricated by forming a cavity in a build-up layer of the microelectronic substrate and filling the cavity with a low-loss dielectric material.

26 Claims, 13 Drawing Sheets

INTEGRATION OF MILLIMETER WAVE ANTENNAS ON MICROELECTRONIC SUBSTRATES

TECHNICAL FIELD

Embodiments of the present description relate generally to the field of microelectronic devices and, more particularly, to the integration of millimeter wave antennas on microelectronic substrates.

BACKGROUND ART

On-package phased-array antennas are generally utilized in combination with millimeter wave microelectronic devices for applications that require the high speed data transmission rates (e.g. gigabytes per second) over wireless links. Low dielectric constant (low-k) and low loss tangent dielectric material are required between elements of the antennas and the underlying ground plane within the microelectronic substrate (to which the antennas and microelectronic devices are attached) to achieve high bandwidth, high gain, and high efficiency, as is understood to those skilled in the art. Currently, the microelectronic substrates used for such microelectronic configurations are not optimized for millimeter wave frequencies (about 30 GHz-300 GHz).

BRIEF DESCRIPTION OF THE DRAWINGS

The subject matter of the present disclosure is particularly pointed out and distinctly claimed in the concluding portion of the specification. The foregoing and other features of the present disclosure will become more fully apparent from the following description and appended claims, taken in conjunction with the accompanying drawings. It is understood that the accompanying drawings depict only several embodiments in accordance with the present disclosure and are, therefore, not to be considered limiting of its scope. The disclosure will be described with additional specificity and detail through use of the accompanying drawings, such that the advantages of the present disclosure can be more readily ascertained, in which:

DESCRIPTION OF THE EMBODIMENTS

Figure 1:
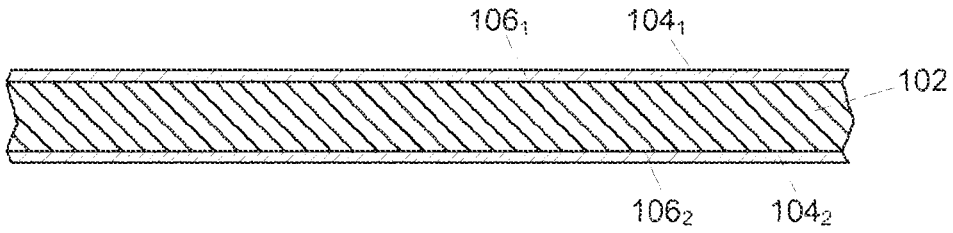
FIGS. 1-8 illustrate side cross-sectional views of a process of forming an antenna on a microelectronic substrate, according to one embodiment of the present description.

In the following detailed description, reference is made to the accompanying drawings that show, by way of illustration, specific embodiments in which the claimed subject matter may be practiced. These embodiments are described in sufficient detail to enable those skilled in the art to practice the subject matter. It is to be understood that the various embodiments, although different, are not necessarily mutually exclusive. For example, a particular feature, structure, or characteristic described herein, in connection with one embodiment, may be implemented within other embodiments without departing from the spirit and scope of the claimed subject matter. References within this specification to "one embodiment" or "an embodiment" mean that a particular feature, structure, or characteristic described in connection with the embodiment is included in at least one implementation encompassed within the present invention. Therefore, the use of the phrase "one embodiment" or "in an embodiment" does not necessarily refer to the same embodiment. In addition, it is to be understood that the location or arrangement of individual elements within each disclosed embodiment may be modified without departing from the spirit and scope of the claimed subject matter. The following detailed description is, therefore, not to be taken in a limiting sense, and the scope of the subject matter is defined only by the appended claims, appropriately interpreted, along with the full range of equivalents to which the appended claims are entitled. In the drawings, like numerals refer to the same or similar elements or functionality throughout the several views, and that elements depicted therein are not necessarily to scale with one another, rather individual elements may be enlarged or reduced in order to more easily comprehend the elements in the context of the present description.

On-package phased-array antennas are generally utilized in combination with millimeter wave microelectronic devices for applications that require the high speed data transmission rates over wireless links, such as the transmission of uncompressed high density (HD) video to a wireless display device. Low dielectric constant (low-k) and low loss tangent dielectric materials are required between elements of the antennas and the underlying ground plane within the microelectronic substrate (to which the antennas and microelectronic devices are attached) to achieve high bandwidth, high gain, and high efficiency. In addition, the microelectronic substrate should have transmission lines between the antennas and the millimeter wave microelectronic devices which have low surface roughness which may result in very low energy loss per unit length, leading to either high throughput or operation low power. Currently, the microelectronic substrates used for such microelectronic configurations are not optimized for millimeter wave frequencies (about 30 GHz-300 GHz). As such, achieving the electrical performance for future high performance microelectronic devices such as system-on-chip ("SOC") devices with integrated millimeter wave radios requires a re-engineering of the microelectronic substrate to increase performance.

Embodiments of the present description may include a high performance antenna, such as 60 GHz or greater millimeter wave antenna, which is fabricated on a microelectronic substrate, such as a traditional printed circuit board or package substrate, as known to those skilled in the art. The antenna may be incorporated on the microelectronic substrate by forming a tow-loss dielectric material structure in the microelectronic substrates and forming the antenna on the low-loss dielectric material structure. The term "low-toss" refers to low loss or dissipation of energy, as will be understood to those skilled in the art. The low-loss dielectric material structures may be fabricated by forming a cavity in a build-up layer of the microelectronic substrate and filling the cavity with a low-loss dielectric material. The low-loss dielectric material may be cured and the antenna formed thereon. It is understood that multiples of such low-loss dielectric material structures and antennas may be fabricated to form a phase array, such as may be required for multi-gigabyte/second wireless data transfer at 60 GHz and above. Thus, the embodiments of the present description may enable the integration of microelectronic devices having millimeter wave radio on low-cost/traditional microelectronic substrates without degrading the electrical performance of the millimeter wave radios.

FIGS. 1-8 illustrate side cross-sectional views of a process of forming an antenna on a microelectronic substrate, according to one embodiment of the present description. As shown in FIG. 1, a substrate core 102 may be formed with a metallization layer $\mathbf{104}_1$ formed on a first side $\mathbf{106}_1$ of the substrate core 102 and a metallization layer $\mathbf{104}_2$ formed on an opposing second side $\mathbf{106}_2$ of the substrate core 102. The substrate core 102 may be any appropriate material, including but not limited to, bismaleimine triazine resin, fire retardant grade 4 material, polyimide materials, glass reinforced epoxy matrix material, and the like, as well as combinations, laminates, and/or multiple layers thereof. The substrate core first side metallization layer $\mathbf{104}_1$ and the substrate core second side metallization layer $\mathbf{104}_2$ may be formed from any appropriate conductive material, including but not limited to copper, aluminum, silver, gold, and the like. The substrate core first side metallization layer $\mathbf{104}_1$ and the substrate core second side metallization layer $\mathbf{104}_2$ may be formed by any technique(s) known in the art, including but not limited to chemical vapor deposition, physical vapor deposition, lamination, lithography, etching, and the like.

Figure 2:
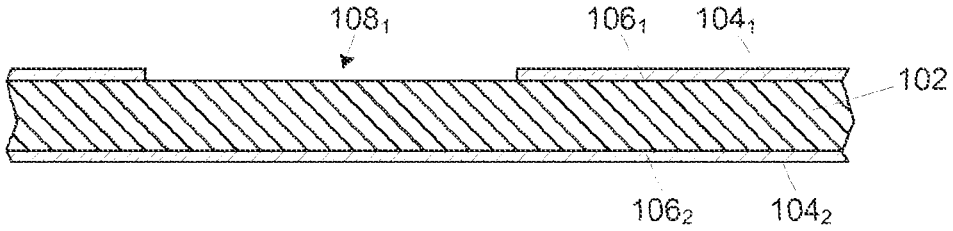

As shown in FIG. 2, an opening 108 may be formed through a portion of the substrate core first side metallization layer $\mathbf{104}_1$. The opening 108 may patterned to define a position for a subsequently formed cavity for the formation of the low-loss dielectric material structure, as will be discussed. The opening $\mathbf{108}_1$ may be formed by any appropriate process including, but not limited to, lithography and etching.

Figure 3:
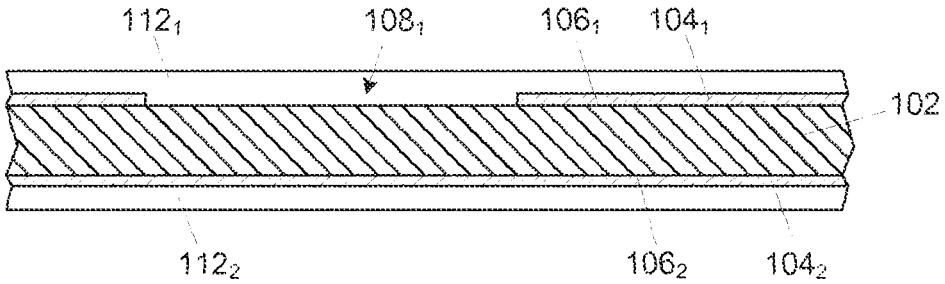

As shown in FIG. 3, a dielectric layer $\mathbf{112}_1$ may be disposed on the substrate core first side $\mathbf{106}_1$ over the substrate core first side metallization layer $\mathbf{104}_1$ and into the opening $\mathbf{108}_1$. A dielectric layer $\mathbf{112}_2$ may also be simultaneous disposed on the substrate core second side $\mathbf{106}_2$ over the substrate core second side metallization layer $\mathbf{104}_2$. The substrate core first side dielectric layer $\mathbf{112}_1$ and the substrate core second side dielectric layer $\mathbf{112}_2$ may be disposed by any process known in the art, including but not limited to, chemical vapor deposition and physical vapor deposition techniques. The substrate core first side dielectric layer $\mathbf{112}_1$ and the substrate core second side dielectric layer $\mathbf{112}_2$ may be formed from any appropriate dielectric, including but not limited to, silicon dioxide ($SiO_2$), silicon oxynitride ($SiO_xN_y$), and silicon nitride ($Si_3N_4$) and silicon carbide (SiC), as well as silica-filled epoxies and the like.

Figure 4:
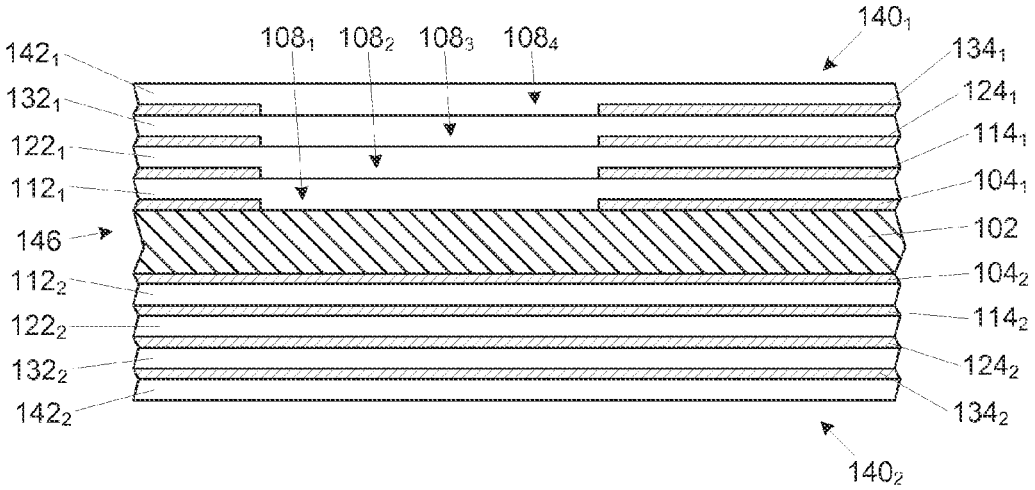

As shown in FIG. 4, additional alternating metallization layers (illustrated as elements $\mathbf{114}_1$, $\mathbf{124}_1$, and $\mathbf{134}_1$) and dielectric layers (illustrated as elements $\mathbf{122}_1$, $\mathbf{132}_1$, and $\mathbf{142}_1$) may be formed on the substrate core first side $\mathbf{106}_1$ to form a first build-up layer $\mathbf{140}_1$. Each of the additional metallization layers (illustrated as elements $\mathbf{114}_1$, $\mathbf{124}_1$, and $\mathbf{134}_1$) may be patterned with openings $\mathbf{108}_2$, $\mathbf{108}_3$, and $\mathbf{108}_4$, respectively, which may be substantially aligned with one another and to the opening $\mathbf{108}_1$ in the substrate core first side metallization layer $\mathbf{104}_1$ to allow for the subsequent formation of a cavity, as will be discussed. As also shown in FIG. 4, additional alternating metallization layers (illustrated as elements $\mathbf{114}_2$, $\mathbf{124}_2$, and $\mathbf{134}_2$) and dielectric layers (illustrated as elements $\mathbf{122}_2$, $\mathbf{132}_2$, and $\mathbf{142}_2$) may be formed on the substrate core second side $\mathbf{106}_2$ to form a second build-up layer $\mathbf{140}_2$. The substrate core 102, the first build-up layer $\mathbf{140}_1$, and the second build-up layer $\mathbf{140}_2$ form a microelectronic substrate 146. It is understood that the metallization layers (illustrated as elements $\mathbf{104}_1$, $\mathbf{104}_2$, $\mathbf{114}_1$, $\mathbf{114}_2$, $\mathbf{124}_1$, $\mathbf{124}_2$, $\mathbf{134}_1$, and $\mathbf{134}_2$) can be conductive traces, power planes, and/or ground planes. If the metallization layers are conductive traces, conductive vias (not shown) may be formed through the dielectric layers (illustrated as elements $\mathbf{112}_1$, $\mathbf{112}_2$, $\mathbf{122}_1$, $\mathbf{122}_2$, $\mathbf{132}_1$, $\mathbf{132}_2$, $\mathbf{142}_1$, and $\mathbf{142}_2$) to form conductive routes to electrically connect various circuit components (not shown), as will be understood to those skilled in the art.

Figure 5:
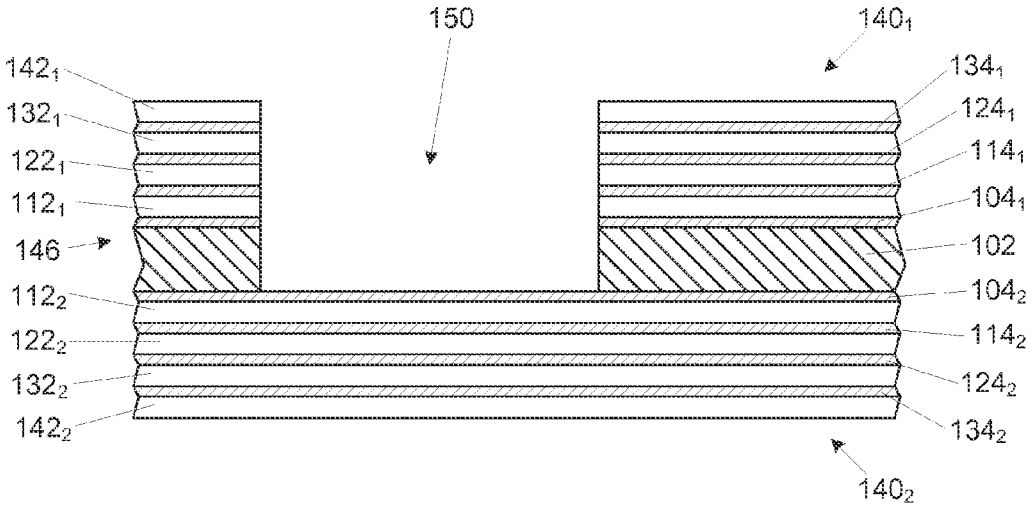

As shown in FIG. 5, a cavity 150 may be formed through the first build-up layer $\mathbf{140}_1$ and at least partially into the substrate core 102 (illustrated completely through the substrate core 102). The cavity 150 may be formed by any technique known in the art including, but not limited to, lithography and etching, laser ablation, ion drilling, and the like.

Figure 6:
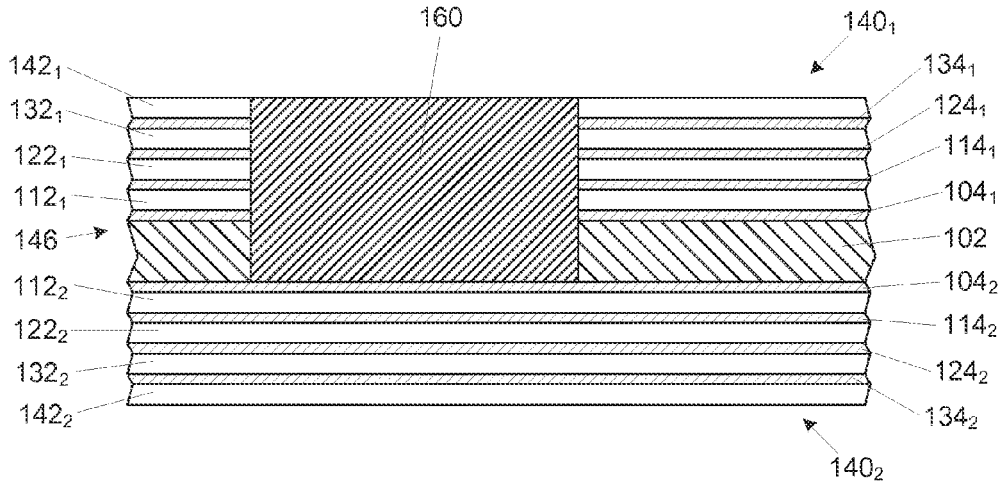

As shown in FIG. 6, a tow-toss dielectric material may be disposed in the cavity 150 (see FIG. 5) to form a low-loss dielectric material structure 160. In one embodiment, the low-loss dielectric material used to form the low-loss dielectric material structure 160 may include, but is not limited to, liquid epoxy, liquid crystal polymer (LCP), benzocyclobutene (BCB), polyimide, and the like. It is understood that although FIG. 6 illustrates a single layer of low-loss dielectric material, the low-loss dielectric material structure 160 may be layers of low-loss dielectric materials. In another embodiment, the low-loss dielectric material used to form the low-loss dielectric material structure 160 may include a comprise of magnetic nanoparticles dispersed in liquid epoxy, liquid crystal polymer (LCP), benzocyclobutene (BCB), polyimide, and the like. When the low-loss dielectric material is disposed in a soft or semi-fluidic form, it may be cured prior to subsequent processing. The magnetic nanoparticles may include, but is not limited to, iron, cobalt, nickel, combinations thereof, and alloys thereof. As will be understood to those skilled in the art, the use of magnetic nanoparticles may allow for fabrication of smaller sized low frequency antennas, as will be discussed. The low-loss dielectric material may be defined to be a dielectric material that has a lower dielectric constant and/or a lower loss tangent than the dielectric material layers (illustrated as elements 112$_1$, 112$_2$, 122$_1$, 122$_2$, 132$_1$, 132$_2$, 142$_1$, and 142$_2$) in the microelectronic substrate 146.

Figure 7:
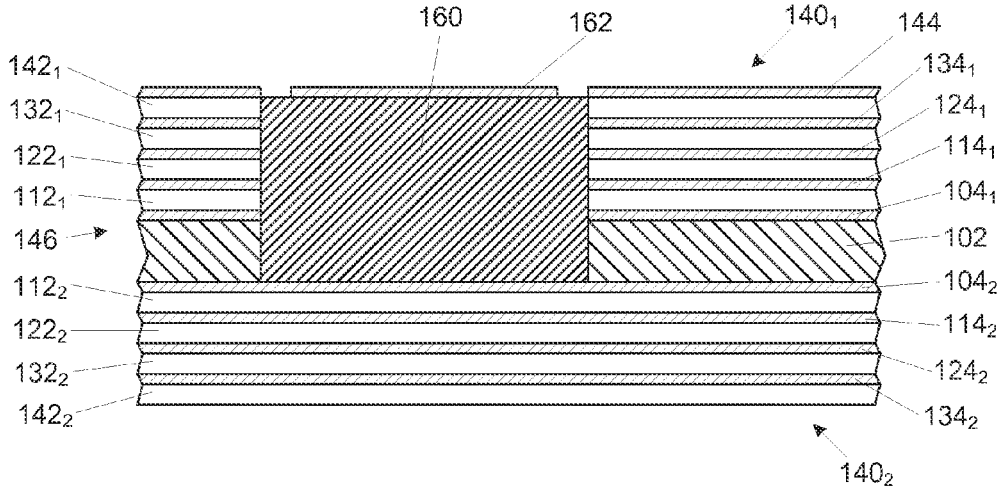

As shown in FIG. 7, an antenna 162 may be formed on the low-loss dielectric material structure 160. The antenna 162 may be formed simultaneously with the formation of a final metallization layer 144, which is formed on the final dielectric layer (illustrated as element 142$_1$), and may be formed from the same conductive material as the final metallization layer 144. However, it is understood that the antenna 162 may be formed separately from the final metallization layer 144 and may be formed from a different material from the final metallization layer 144. The antenna 162 may be formed by any known technique known in the art, including, but not limited to, deposition and lithographic patterning techniques.

Figure 8:
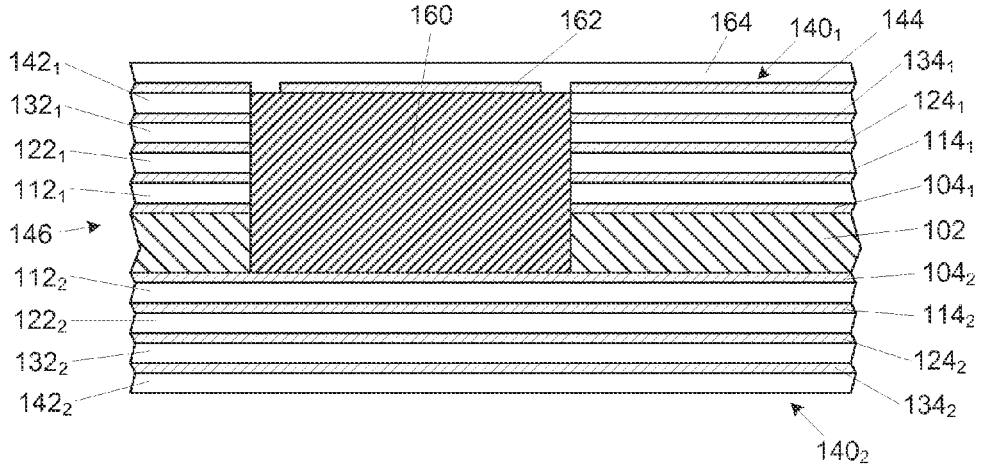

As shown in FIG. 8, a solder resist material layer 164 may be formed over the antenna 162 and the final metallization layer 144. The solder resist material layer 164 may be used for flip-chip attachment of microelectronic device, as will be discussed and as will be understood to those skilled in the art.

Figure 9:
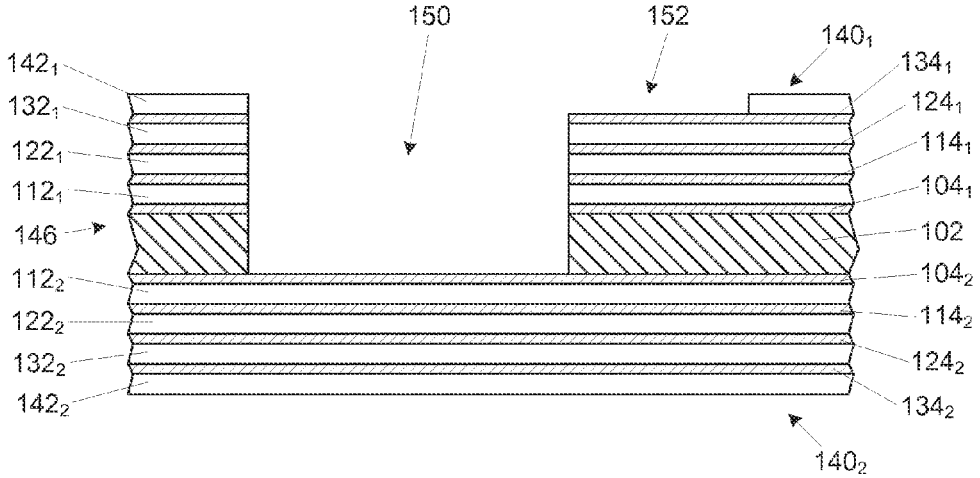
FIGS. 9-12 illustrate side cross-sectional views of a process of forming an antenna on a microelectronic substrate, according to another embodiment of the present description.
Figure 10:
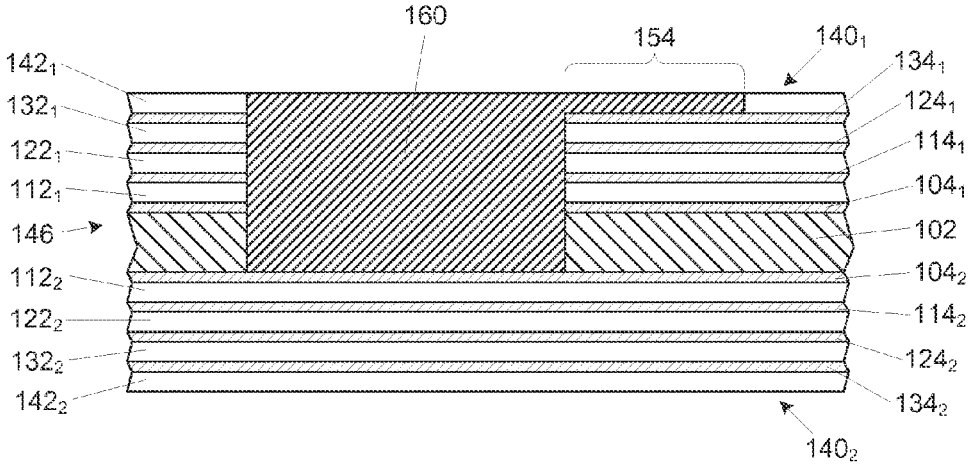

FIGS. 9-12 illustrate side cross-sectional views of a process of forming an antenna in a microelectronic substrate, according to one embodiment of the present description. Beginning with the structure illustrated in FIG. 5, the cavity 150 may be formed through the first build-up layer 140$_1$ and the substrate core 102. Additionally, a portion of a final dielectric layer (illustrated as dielectric layer 142$_1$) may be removed to form a trench 152, as shown in FIG. 9. As show in FIG. 110, the low-loss dielectric material may be disposed in the cavity 150 (see FIG. 9) to form a low-loss dielectric material structure 160, wherein a portion of the low-loss dielectric material is disposed in the area of where a portion of the final dielectric layer (illustrated as dielectric layer 142$_1$) was removed to form a transmission line isolation structure 154.

Figure 11:
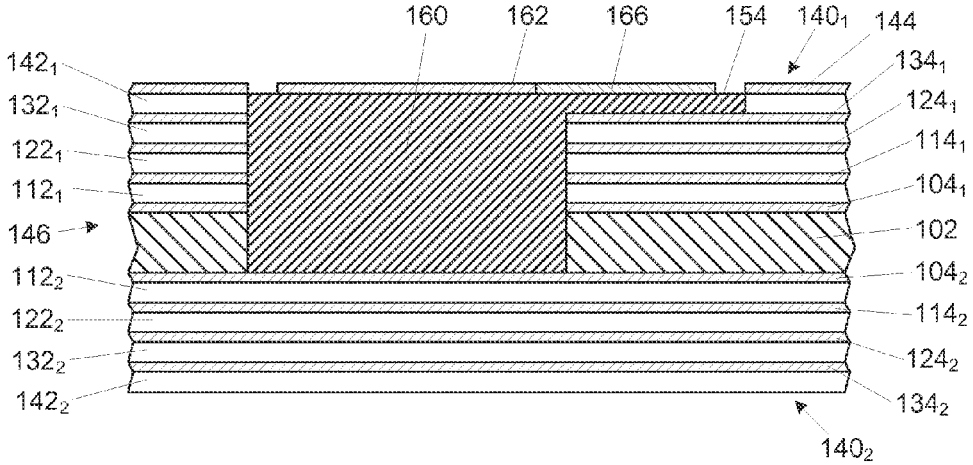
Figure 12:
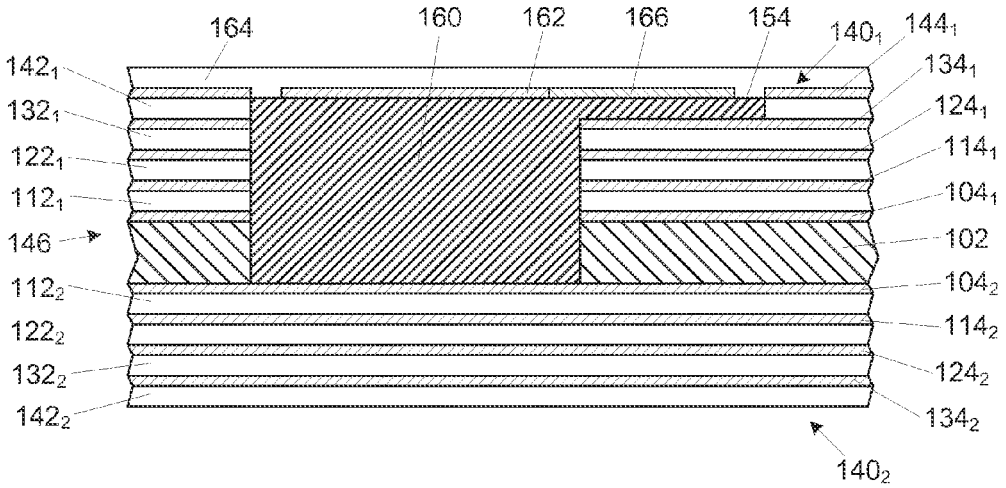

As shown in FIG. 11, the antenna 162 may be formed on the low-loss dielectric material structure 160 and a transmission line 166 formed on the transmission line isolation structure 154. The transmission line 166 may be formed from any appropriate conductive material including but not limited to copper, aluminum, silver, gold, and the like. The transmission line 166 may be formed simultaneously with the formation of the final metallization layer 144, and may be formed by any technique known in the art including but not limited to lithographic and deposition techniques. As shown in FIG. 12, the solder resist material layer 164 may be formed over the antenna 162, the transmission line 166, and the final metallization layer 144.

Figure 17:
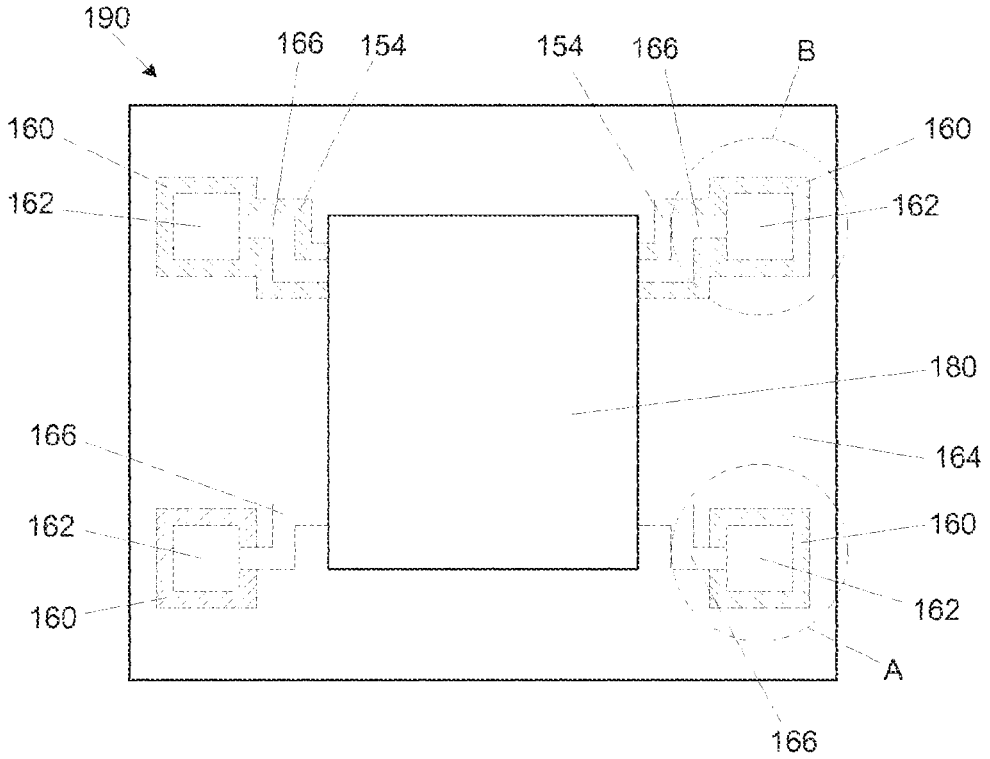
FIG. 17 illustrates a top plan view of a microelectronic package having an antenna formed by the method illustrated in FIGS. 1-8 and an antenna firmed by the method illustrated in FIGS. 9-12, according to embodiments of the present description.

Referring to FIG. 17, a top plane view of a microelectronic structure 190. The insert B illustrates the structure that may result from the process discussed in FIGS. 9-13. As illustrated, the transmission lines 166, which may connect integrated millimeter wave radio(s) (not shown) within a microelectronic device 180 with the antenna 162 formed on the low-loss dielectric material structure 160, are disposed on and may follow the path of the transmission line isolation structure 154. The transmission line isolation structure 154 may assist to minimize signal losses between the microelectronic device 180 and the antenna 162. As also shown in FIG. 17 and specifically shown in insert A therein, the transmission line 166 may be formed on the final dielectric layer (illustrated as dielectric layer 142$_1$ in FIGS. 4-12), as would be the case with the process illustrated in FIGS. 1-8, where signal losses between the microelectronic device 180 and the antenna 162 are not significant. It is noted that the low-loss dielectric material structures 160, antennas 162, the transmission line isolation structures 154, and transmission lines 166 are illustrated in shadow lines as they would be wider the solder resist material layer 164 in the top plane view. The microelectronic device 180 may be attached to the final metallization layer (illustrated as element 144) with a ball grid array, as will be understood to those skilled in the art. However, the microelectronic device 180 may also be attached by other mechanisms including but not limited to land grid arrays, pin/socket arrange, wire bonds, and the like.

Figure 13:
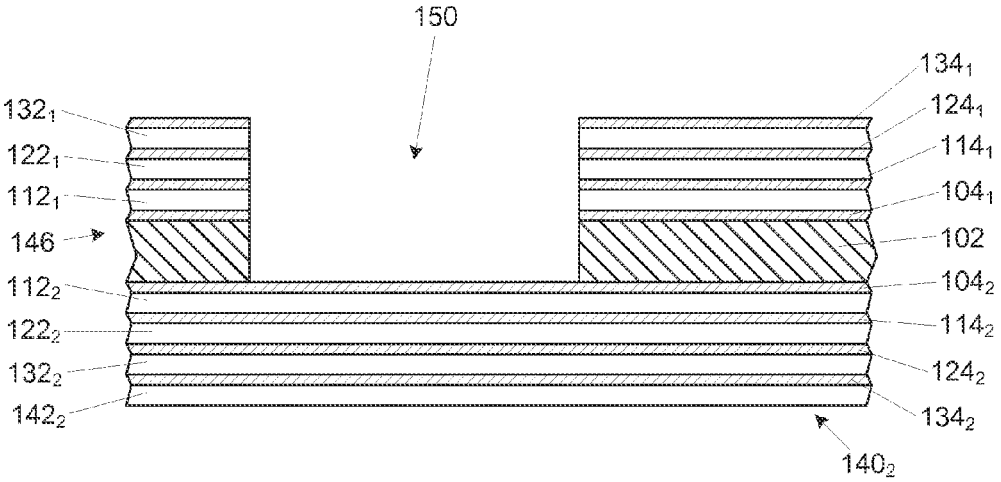
FIGS. 13-16 illustrate side cross-sectional views of a process of forming an antenna on a microelectronic substrate, according to still another embodiment of the present description.
Figure 14:
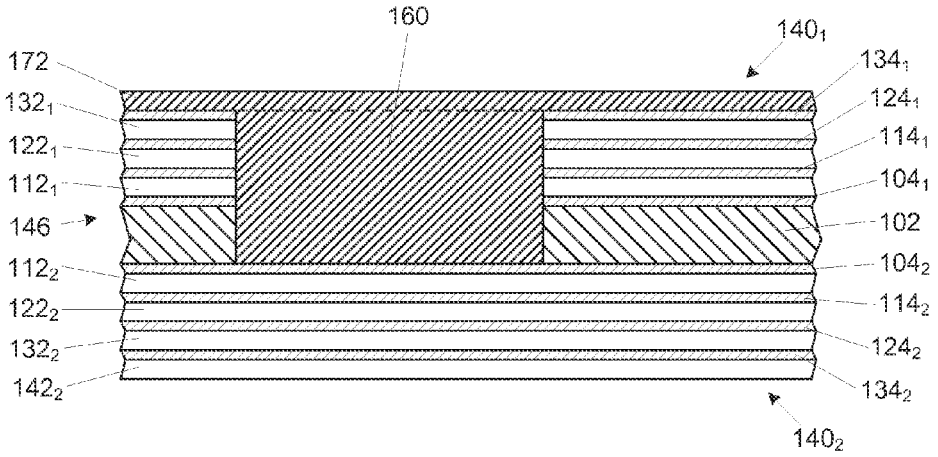
Figure 15:
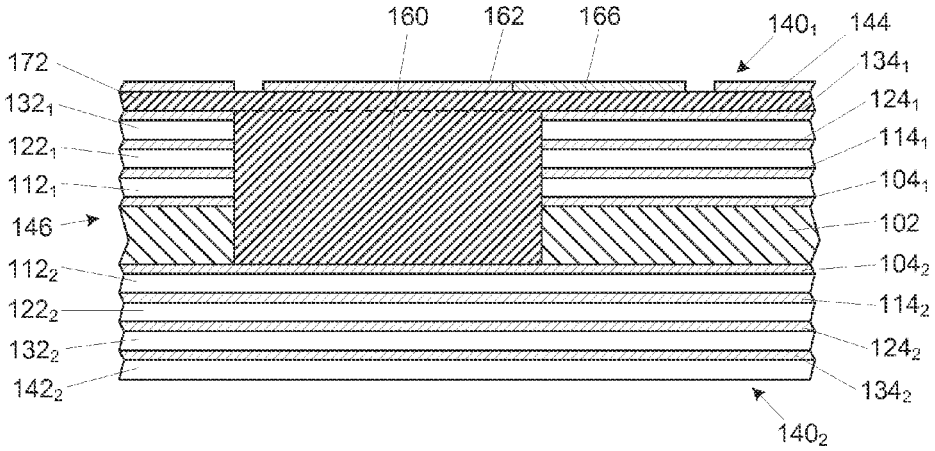
Figure 16:
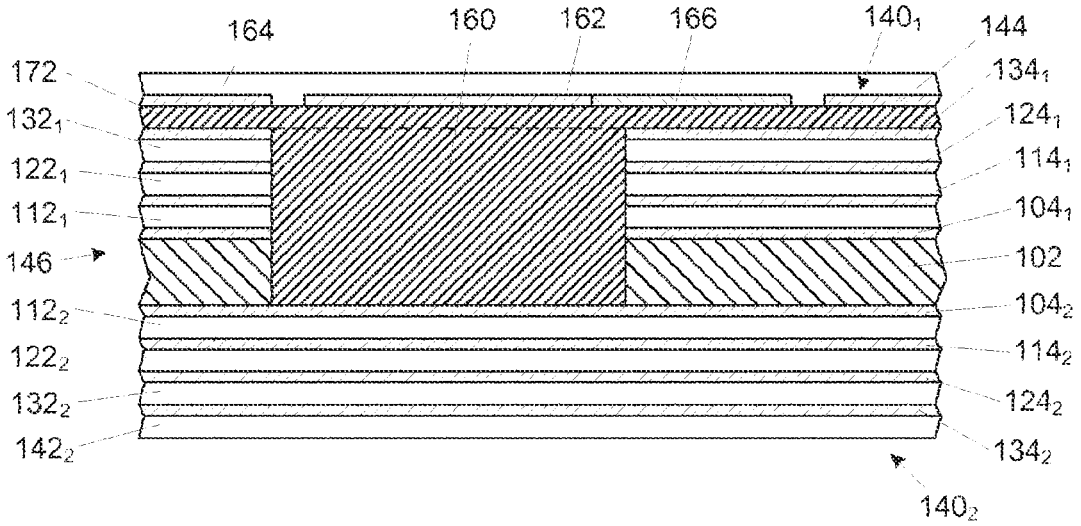

When a significant number of antennas 162 are to be formed, the final dielectric layer (illustrated as dielectric layer 142$_1$ in FIGS. 4-12) may be formed of a low-loss dielectric material, as illustrated in the embodiment of FIGS. 13-16. As shown in FIG. 13, the cavity 150 may be formed through the first build-up layer 140$_1$ and the substrate core 102. As shown in FIG. 14, the low-loss dielectric material may be disposed in the cavity 150 (see FIG. 5) to form the tow-toss dielectric material structure 160 and may be simultaneously disposed over the upper-most metallization layer (illustrated as element 134$_1$) to form a low-loss final dielectric material layer 172. However, it is understood that the low-loss dielectric material structure 160 may be formed and the final dielectric material layer 172 may be a low-loss dielectric material deposited or laminated over the upper-most metallization layer (illustrated as element 134$_1$). As shown in FIG. 15, the antenna 162 may be formed on the low-loss dielectric material structure 160 and the transmission line 166 formed on the low-loss dielectric material layer 172. Thus, the entire low-low dielectric material layer 172 becomes a transmission line isolation structure. As shown in FIG. 16, the solder resist material layer 164 may be formed over the antenna 162, the transmission line 166, and the final metallization layer 144.

Figure 18:
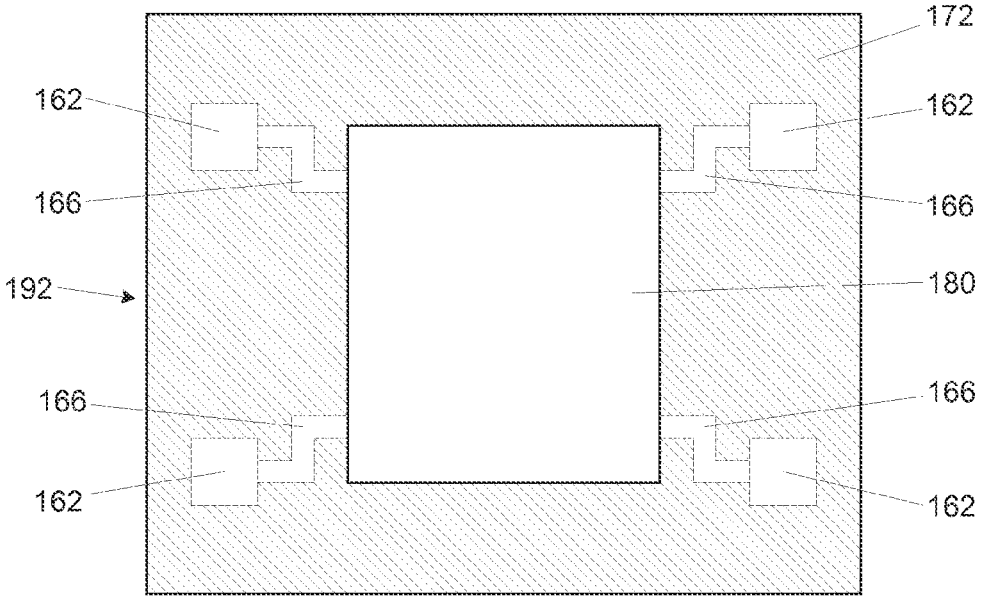
FIG. 18 illustrates a top plan view of a microelectronic packaging have an antenna formed by the method illustrated in FIGS. 13-16, according to one embodiment of the present description.

Referring to FIG. 18, a top plane view of a microelectronic structure 192 that may result from the process discussed in FIGS. 13-16. As illustrated, the transmission lines 166, which may connect integrated millimeter wave radio(s) (not shown) within a microelectronic device 180 with the antenna 162 formed on the low-loss dielectric material structure 160, are disposed on the low-loss final dielectric material layer 172. It is noted that the low-loss dielectric material layer 172, antennas 162, and transmission lines 166 are illustrated in shadow lines as they would be under the solder resist material 164 in the top plane view.

Figure 19:
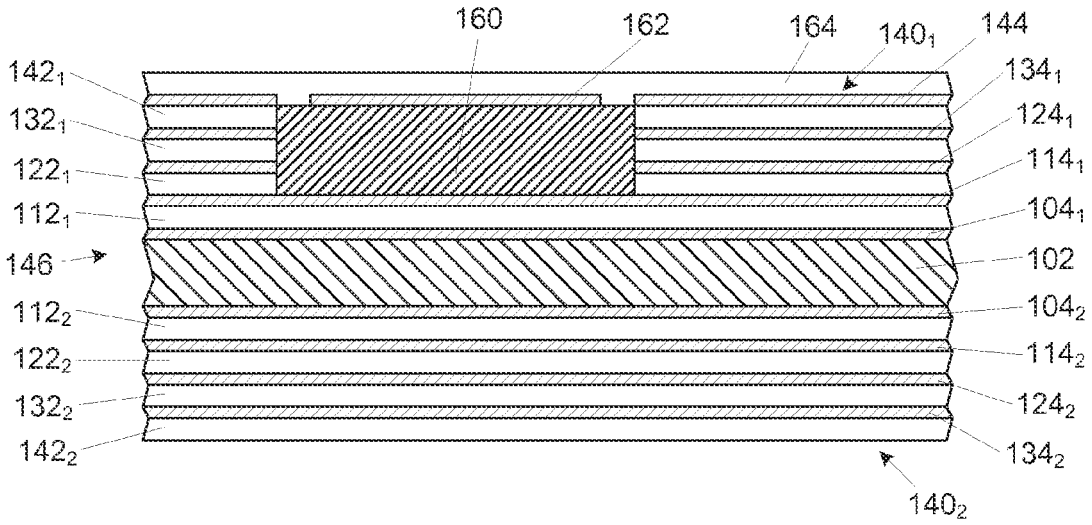
FIG. 19 illustrates a side cross-sectional view of an antenna on a microelectronic substrate, according to an embodiment of the present description.
Figure 20:
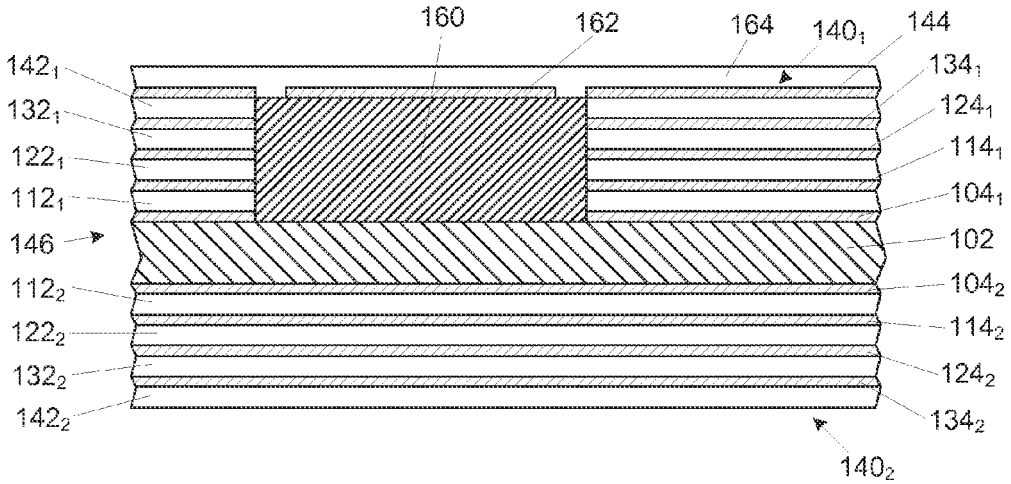
FIG. 20 illustrates a side cross-sectional view of an antenna on a microelectronic substrate, according to another embodiment of the present description.
Figure 21:
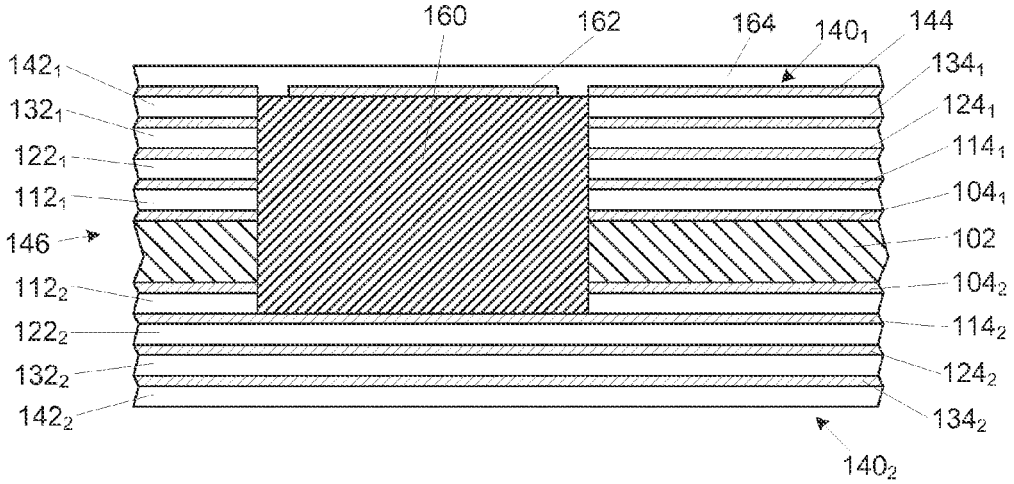
FIG. 21 illustrates a side cross-sectional view of an antenna on a microelectronic substrate, according to still another embodiment of the present description.

Although the embodiments illustrated in FIGS. 1-16 result in the low-loss dielectric material structure 160 extending through the substrate core 102, the subject matter of this description is not so limited. The low-loss dielectric material structure 160 may extend only partially into to the first build-up layer 140$_1$, as shown in FIG. 19. Additionally, the low-loss dielectric material structure 160 may extend through the first build-up layer 140$_1$ to stop at the substrate core 102, as shown in FIG. 20. Furthermore, the low-loss dielectric material structure 160 may extend through the first build-up layer 140$_1$, through the substrate core 102, and extend into the second build-up layer 140$_2$, as shown in FIG. 21. The selection of how far the low-loss dielectric material structure 160 extends into the substrate 146 (i.e. the thickness of the low-loss dielectric material structure 160) will depend on the bandwidth required, as will be understood to those skilled in the art.

Figure 22:
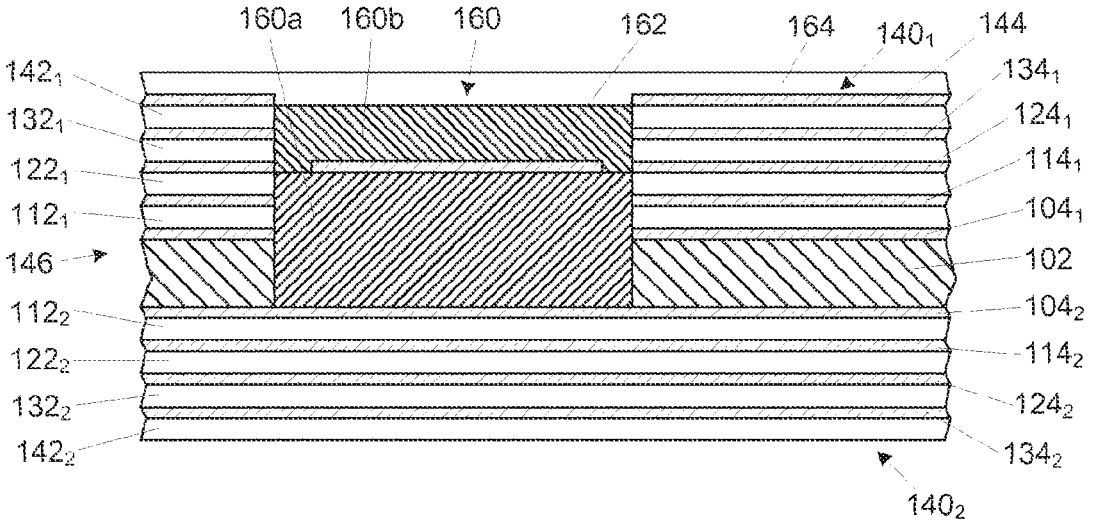
FIG. 22 illustrates a side cross-sectional view of an embedded antenna in a microelectronic substrate, according to an embodiment of the present description.
Figure 23:
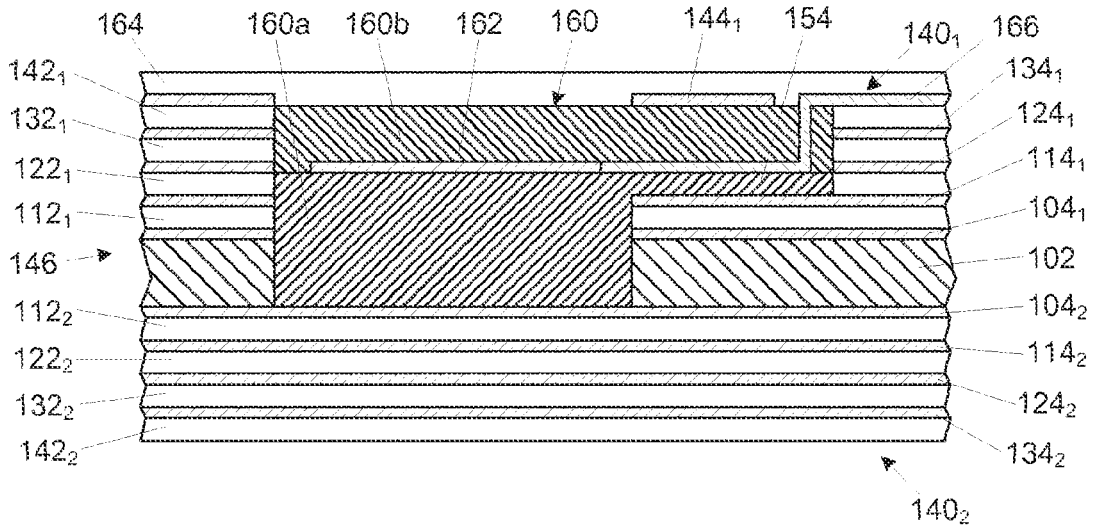
FIG. 23 illustrates a side cross-sectional view of an embedded antenna in a microelectronic substrate, according to another embodiment of the present description.

Furthermore, as shown in FIGS. 22 and 23, the antenna 162 may be incorporated within the low-loss dielectric material structure 160. This may be achieved by forming the low-loss dielectric material structure 160 with layers of low-loss dielectric materials. As shown in FIG. 22, a first low-loss material layer 160*a* may be deposited and the antenna 162 formed thereon. A second low-loss material layer 160*b* may be deposited over the first low-loss material layer 160*a* and the antenna 162, thereby encapsulating the antenna 162 and forming the low-loss dielectric material structure 160. The antenna 162 may be connected to a microelectronic device in a manner previously discussed.

As shown in FIG. 23, the transmission line isolation structure 154 may also be formed during formation of encapsulated antenna 162, as shown in FIG. 22. The formation of the transmission line isolation structure 154 may be achieved in any appropriate manner, such as previously described in FIGS. 9-12.

Figure 24:
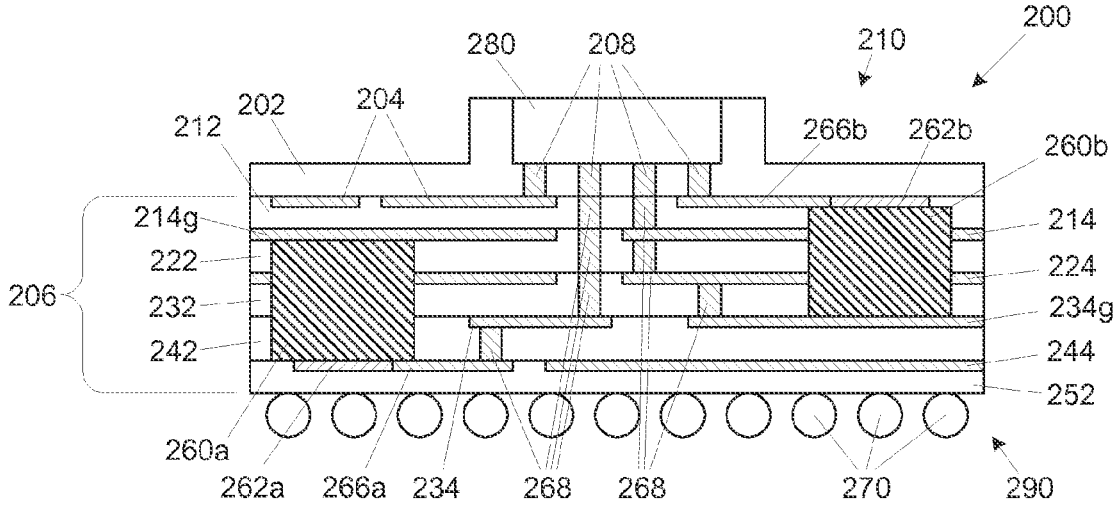
FIG. 24 illustrates a side cross-sectional view of an antenna in a bumpless build-up layer microelectronic substrate, according to an embodiment of the present description.

It is understood that the subject matter of this description is not limited to cored substrates, such as the microelectronic substrate 146, but may also be incorporated into any appropriate substrate, such as the coreless microelectronic substrate 192 illustrated in FIG. 24. As shown in FIG. 24, low-loss dielectric material structures (illustrated as elements 260*a* and 260*b*) and antennas (illustrated as elements 262*a* and 262*b*) may be formed in a bumpless build-up layer coreless (BBUL-C) microelectronic package 200. As will be understood to those skilled in the art, the BBUL-C microelectronic package 200 may comprise a microelectronic device 280 (such as previously described with regard to microelectronic device 180) embedded in an encapsulant material 202. The encapsulation material 202 may be a silica-filled epoxy, such as build-up films available from Ajinomoto Fine-Techno Co., Inc., 1-2 Kawasaki-ku, Kawasaki-shi, 210-0801, Japan (e.g. Ajinomoto ABF-GX13, Ajinomoto GX92, and the like). A build-up layer 206 may be formed from alternating metallization layers (illustrated as elements 204, 214, 224, 234, and 244) and dielectric layers (illustrated as elements 212, 222, 232, 242, and 252) may be built up from the encapsulation material 202. A plurality of conductive vias 208 may be formed between the microelectronic device 280 and the build-up layer 206 for electrical communication therebetween. The metallization layers (illustrated as elements 204, 214, 224, 234, and 244) may be interconnected by conductive vias 268 extending through the various dielectric layers (illustrated as elements 212, 222, 232, and 242). External interconnects 270, such as solder bumps, may be formed proximate the final dielectric layer 252 for connection to external device(s) (not shown). As will be understood to those skilled in the art, the external interconnects 270 may be connection to at least one metallization layer, such as metallization layer 244, with conductive vias (not shown).

A first antenna 262*a* may be formed proximate an attachment side 290 of the microelectronic package 200 on a low-loss dielectric structure 260*a*. A portion of the metallization layer 214 may be the antenna ground 214*g*. The first antenna 262*a* may be connected to the microelectronic device 280 through a transmission line 266*a* and various vias and metallization layers. A second antenna 262*b* may be formed proximate a microelectronic device side 210 of the microelectronic package 200 on a low-loss dielectric structure 260*b*. A portion of the metallization layer 234 may be the antenna ground 234*g*. The second antenna 262*b* may be connected to the microelectronic device 280 through a transmission line 266*b* and a conductive via 208. It is understood that the first antenna 262*a* and/or the second antenna 262*b* may be embedded in the low-loss dielectric structure 260*a* and 260*b*, respectively, as previously discussed.

Figure 25:
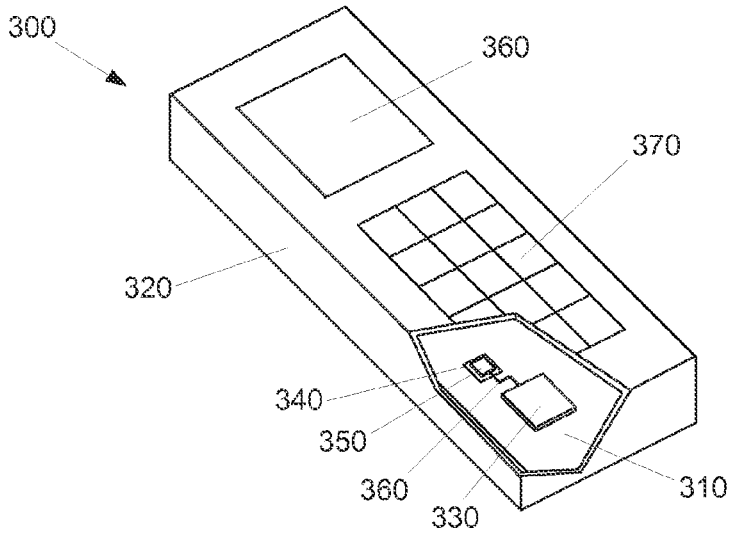
FIG. 25 illustrates an electronic system/device, according to one implementation of the present description.
Figure 26:
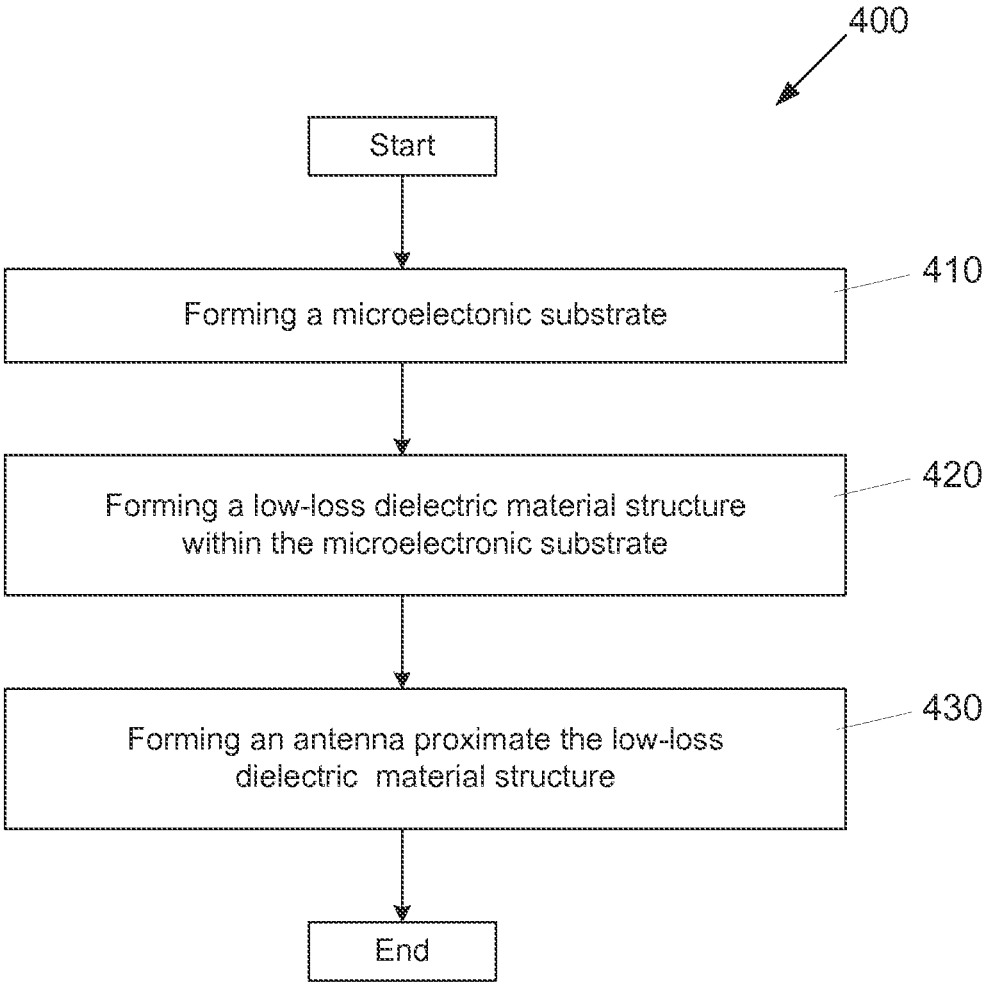
FIG. 26 illustrates a flow diagram of a process of forming an antenna on a microelectronic substrate, according to one embodiment of the present description.

As will be understood to those skilled in the art, antennas 160/260*a*/260*b*, whether embedded or implemented on the surface of the substrate, may radiate in parallel (endfire radiation) to the plane of implementation or it may radiate perpendicular (boresight radiation) to the plane FIG. 25 illustrates an embodiment of an electronic system/device 300, such as a portable computer, a desktop computer, a mobile telephone, a digital camera, a digital music player, a web tablet/pad device, a personal digital assistant, a pager, an instant messaging device, or other devices. The electronic system/device 300 may be adapted to transmit and/or receive information wirelessly, such as through a wireless local area network (WLAN) system, a wireless personal area network (WPAN) system, and/or a cellular network. The electronic system/device 300 may include a microelectronic substrate 310 (such as the microelectronic substrate 146 in FIGS. 4-22) within a housing 320. As with the embodiments of the present application, the microelectronic substrate 310 may include a microelectronic device 330 (such as microelectronic device 180 for FIGS. 17 and 18) and a low-loss dielectric material structure 340 (such as low-loss dielectric material structure 160 of FIGS. 6-8, 10-12, 14-17, and 19-22) formed therein. An antenna 350 (such as antenna 162 of FIGS. 7, 8, 11, 12, and 15-22) may be formed in or on (shown as "on") the low-loss dielectric material structure 340, wherein the antenna 350 may be connected to the microelectronic device 330 with a transmission line 360 (such as transmission line 166 of FIGS. 11, 12, and 15-18). The microelectronic substrate 310 may be attached to various peripheral devices including an input device 370, such as keypad, and a display device 380, such an LCD display. It is understood that the display device 380 may also function as the input device, if the display device 380 is touch sensitive.

An embodiment of one process of fabricating a microelectronic structure of the present description is illustrated in a flow diagram 400 of FIG. 25. As defined in block 410, a microelectronic substrate may be formed. A low-loss dielectric material structure may be formed within the microelectronic substrate, as defined in block 420. As defined in block 430, an antenna may be formed in or on the low-loss dielectric material structure.

It is understood that the subject matter of the present description is not necessarily limited to specific applications illustrated in FIGS. 1-26. The subject matter may be applied to other microelectronic device fabrication applications, as will be understood to those skilled in the art.

Having thus described in detail embodiments of the present invention, it is understood that the invention defined by the appended claims is not to be limited by particular details set forth in the above description, as many apparent variations thereof are possible without departing from the spirit or scope thereof.

What is claimed is:

1. A microelectronic structure, comprising:

a microelectronic substrate comprising a substrate core having a first build-up layer on a first surface thereof;

a low-loss dielectric material structure formed through the first build-up layer and at least partially into the substrate core of the microelectronic substrate; and an antenna disposed on the low-loss dielectric material structure.

2. The microelectronic structure of claim 1, wherein the antenna abuts the low-loss dielectric material structure.

3. The microelectronic structure of claim 1, wherein the antenna is embedded in the low-loss dielectric material structure.

4. The microelectronic structure of claim 1, wherein the low-loss dielectric material structure is selected from the group comprising epoxy, crystal polymer, benzocyclobutene, and polyimide.

5. The microelectronic structure of claim 1, wherein the low-loss dielectric material structure includes magnetic nanoparticles.

6. The microelectronic structure of claim 1, further including a microelectronic device attached to the microelectronic substrate and a transmission line connecting the microelectronic device to the antenna.

7. The microelectronic structure of claim 6, further including a transmission line isolation structure formed in the microelectronic substrate, wherein the transmission line is disposed on the transmission line isolation structure.

8. The microelectronic structure of claim 1, wherein the first build-up layer comprises a plurality of alternating metallization layers and dielectric layers.

9. The microelectronic structure of claim 1, wherein the microelectronic substrate further comprises a second build-up layer on a second surface of the substrate core opposing the substrate core first surface, and wherein the low-loss dielectric material structure formed within the microelectronic substrate is formed through the first build-up layer, through the substrate core, and at least partially into the second build-up layer.

10. The microelectronic structure of claim 1, wherein the microelectronic substrate comprises a bumpless build-up layer coreless microelectronic substrate.

11. A method of fabricating a microelectronic structure, comprising:

forming a microelectronic substrate comprising a substrate core having a first build-up layer on a first surface thereof;

forming a low-loss dielectric material structure through the first build-up layer and at least partially into the substrate core of the microelectronic substrate; and forming an antenna on the low-loss dielectric material structure.

12. The method of claim 11, wherein forming the antenna proximate the low-loss dielectric material structure comprises forming the antenna to abut the low-loss dielectric material structure.

13. The method of claim 11, wherein forming the antenna proximate the low-loss dielectric material structure comprises embedding the antenna within the low-loss dielectric material structure.

14. The method of claim 11, wherein forming the low-loss dielectric material structure comprises forming the low-loss dielectric material structure from a low-loss dielectric material selected from the group comprising epoxy, crystal polymer, benzocyclobutene, and polyimide.

15. The method of claim 11, wherein forming a low-loss dielectric material structure within the microelectronic substrate comprises forming a low-loss dielectric material structure having magnetic nanoparticles dispensed therein within the microelectronic substrate.

16. The method of claim 11, wherein the forming the low-loss dielectric material structure comprises forming a cavity in the microelectronic substrate and disposing a low-loss dielectric material within the cavity.

17. The method of claim 11, further including attaching a microelectronic device to the microelectronic substrate and connecting the microelectronic device to the antenna with a transmission line.

18. The method of claim 17, further including forming a transmission line isolation structure formed in the microelectronic substrate, wherein the transmission line is disposed on the transmission line isolation structure.

19. The method of claim 11, wherein the first build-up layer comprises a plurality of alternating metallization layers and dielectric layers.

20. The method of claim 11, further including forming a second build-up layer on a second surface of the substrate core opposing the substrate core first surface, and wherein forming the low-loss dielectric material structure within the microelectronic substrate comprises forming the low-loss dielectric material structure through the first build-up layer, through the substrate core, and at least partially into the second build-up layer.

21. The method of claim 19, further including forming a transmission line isolation structure in a final dielectric layer of the first build-up layer of the microelectronic substrate.

22. The method of claim 21, further including attaching a microelectronic device to the microelectronic substrate with a final metallization layer formed on the final dielectric layer; and connecting the microelectronic device to the antenna with a transmission line disposed on the transmission line isolation structure.

23. The method of claim 11, wherein forming a microelectronic substrate comprises forming a bumpless build-up layer coreless microelectronic substrate.

24. An electronic system, comprising:

a housing;

a microelectronic substrate disposed within the housing, wherein the a microelectronic substrate comprises a substrate core having a first build-up layer on a first surface thereof;

a low-loss dielectric material structure formed through the first build-up layer and at least partially into the substrate core of the microelectronic substrate; and an antenna disposed on the low-loss dielectric material structure.

25. The electronic system of claim 24, further including a microelectronic device attached to the microelectronic substrate and a transmission line connecting the microelectronic device to the antenna.

26. The electronic system of claim 25, further including a transmission line isolation structure formed in the microelectronic substrate, wherein the transmission line is disposed on the transmission line isolation structure.

* * * * *